US006094787A

United States Patent [19]

Chang

[11] Patent Number: 6,094,787

[45] Date of Patent: Aug. 1, 2000

[54] FASTENING DEVICE

[76] Inventor: Chun-Hsiung Chang, No. 5-4, Lane 201, Rd. Chung-Hua, Pa-Der Shih, Tao-Yuan Hsien, Taiwan

[21] Appl. No.: 09/033,592

[22] Filed: Mar. 3, 1998

[51] Int. Cl.[7] ..... F16G 11/00

[52] U.S. Cl. ..... 24/712.6; 24/712.1

[58] Field of Search ..... 24/712.6, 712.2, 24/712.5, 713.6, 132 R, 132 AA, 133

[56] References Cited

U.S. PATENT DOCUMENTS

| | | | |
|---|---|---|---|
| 526,830 | 10/1894 | Dulje | 24/712.5 |
| 1,363,693 | 12/1920 | Swanson | 24/712.6 |
| 5,097,573 | 3/1992 | Gimeno | 24/712.6 |
| 5,129,130 | 7/1992 | Lecouturier | 24/712.6 |

*Primary Examiner*—Victor N. Sakran
*Attorney, Agent, or Firm*—Bacon & Thomas

[57] ABSTRACT

A fastening device for repeatedly loosenably fastening a lace without detachment, including a panel body and at least one engaging block. Two ends of the panel body are formed with cut sections each having a locating shaft. The locating shaft is formed with a concave. The central portion of the panel body is formed with multiple lace holes through which the lace is passed. The engaging block is formed with a central recess in which the locating shaft is fitted to define a lace access gap. The wall of the recess of the engaging block is formed with stopper projections. A resilient tongue plate is formed on outer edge of the recess. When the engaging block is forcedly outward turned by a lace passing through the gap, the tongue plate and the stopper projections provide resilient restoring pressure due to the change of distance between the centers of the locating shaft and the recess. The restoring pressure acts as a clasping force for clamping and tightening the lace. When the engaging blocks at two ends of the fastening device are pinched, the lace is released from the clasping force, permitting the fastening device to be freely slided along the lace to a desired position without detaching from the lace. Then the lace can be pulled to be again tightened by the fastening device.

5 Claims, 6 Drawing Sheets

FASTENING DEVICE

BACKGROUND OF THE INVENTION

The present invention relates to a fastening device which permits a lace to be easily passed therethrough and is able to loosenably fasten the lace by pulling the lace without knotting.

It is known that a lace is usually tightened by manually tying the lace into a butterfly knot. Such procedure is time-consuming and it is difficult to adjust the tightness of the lace. In addition, in use, the knot tends to loosen. Also, the knot is often tied asymmetrically to present a poor appearance.

SUMMARY OF THE INVENTION

It is a primary object of the present invention to provide a fastening device which permits the free ends of a lace to be passed therethrough and is able to fasten the lace only by pulling the lace. Without detaching from the lace, the fastening device can be easily untightened and slided along the lace to another position and again fastened. Without manually tying the lace into butterfly knot, the fastening device can repeatedly fasten or untighten the lace.

According to the above object, the fastening device of the present invention includes a panel body and at least one engaging block. The panel body is formed with a certain number of lace holes through which the lace is passed. Two ends of the panel body are formed with cut sections each having a locating shaft. The locating shaft is formed with a concave. The engaging block is formed with a central recess in which the locating shaft is fitted to define a lace access gap. The wall of the recess of the engaging block is formed with stopper projections. A resilient tongue plate is formed on outer edge of the recess. When the engaging block is forcedly outward turned by a lace passing through the gap, the tongue plate and the stopper projections provide resilient restoring pressure. The restoring pressure serves as a clamping force for tightly clamping and fastening the lace. When the engaging blocks at two ends of the fastening device are pinched, the lace is released from the clamping force, permitting the fastening device to be freely slided along the lace to a desired position without detaching from the lace. Then the lace can be repeatedly pulled to be again tightened by the fastening device.

The present invention can be best understood through the following description and accompanying drawings, wherein:

DETAILED DESCRIPTION OF THE PREFERRED EMBODIMENT

Figure 1:
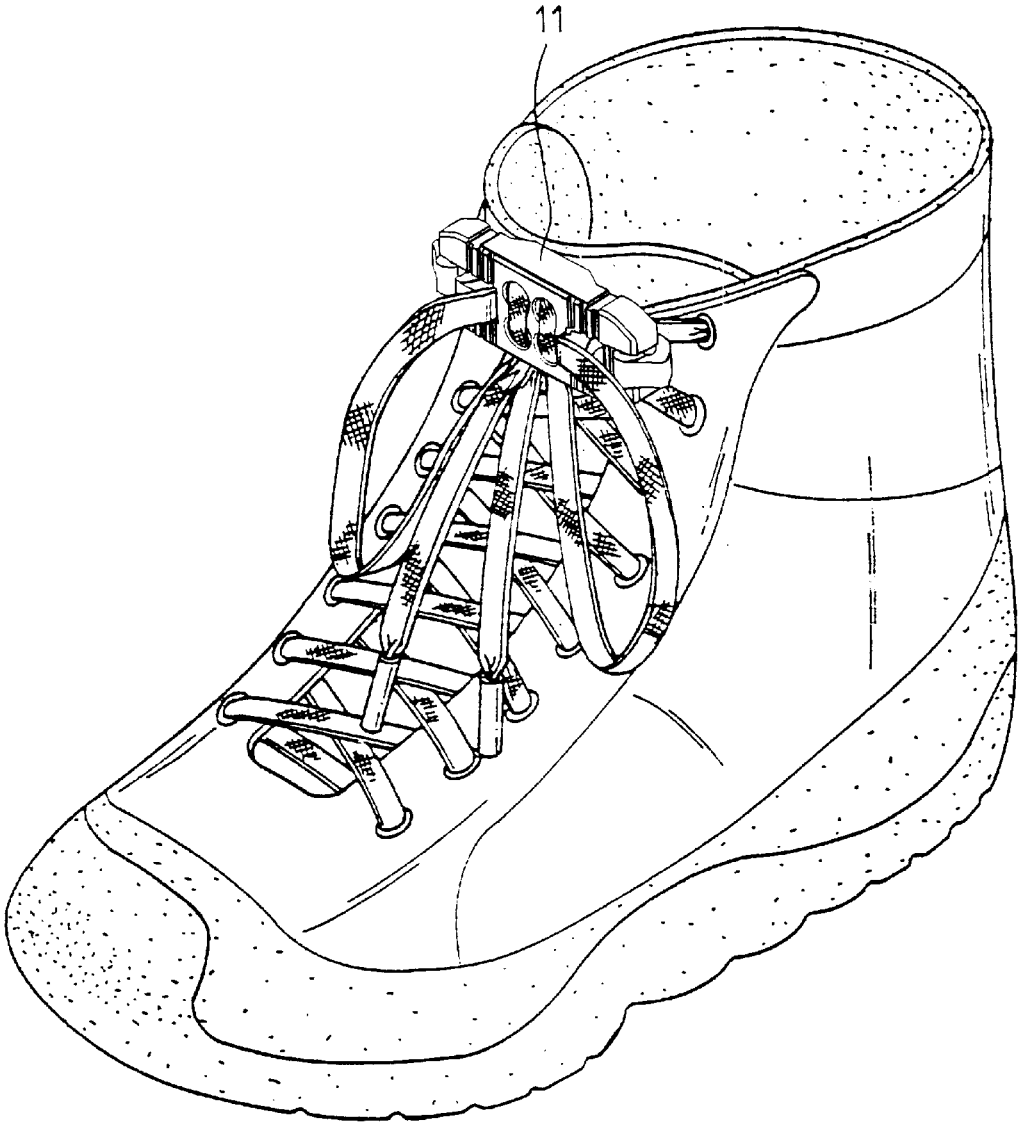
FIG. 1 shows the application of the fastening device of the present invention to a shoe lace.
Figure 2:
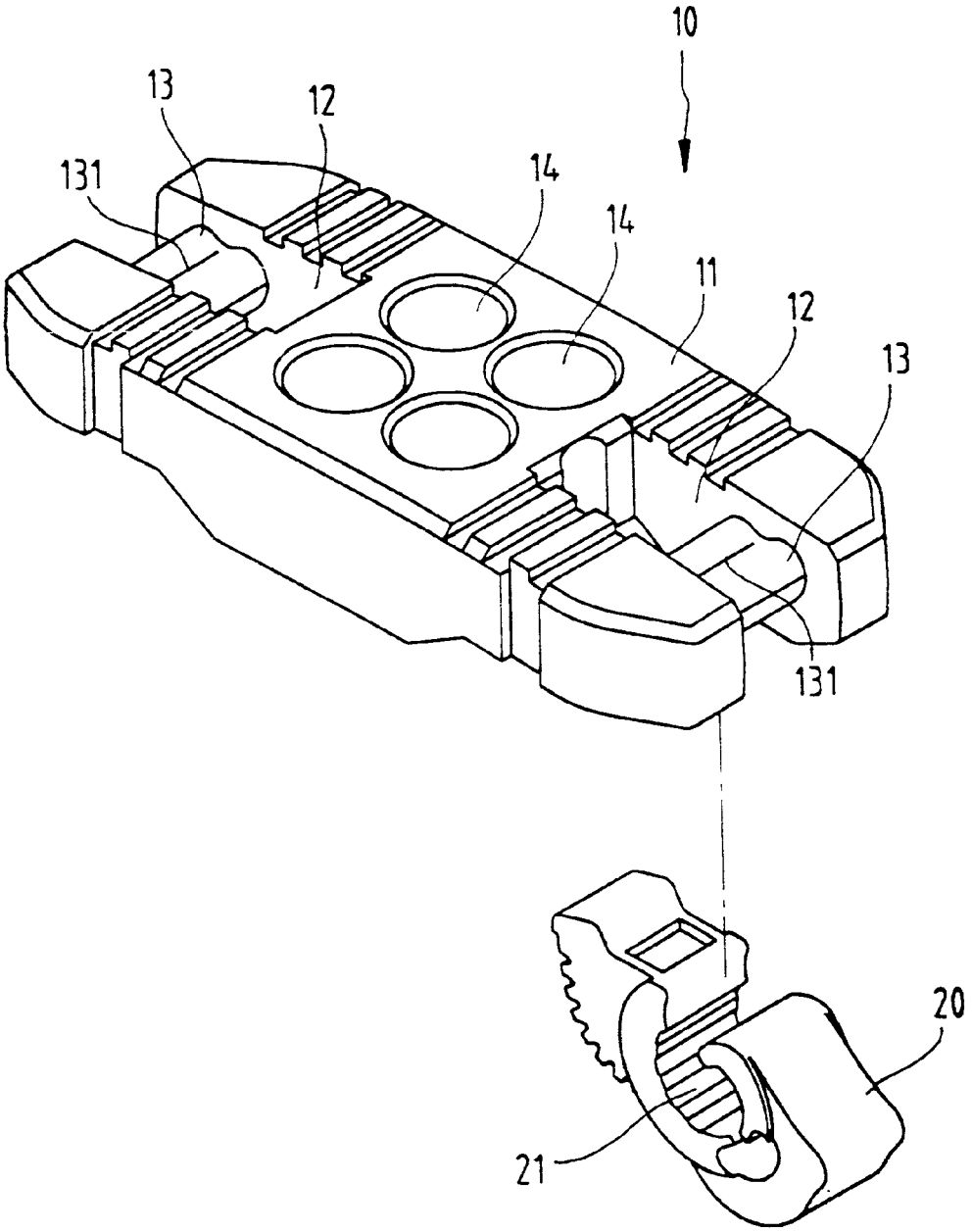
FIG. 2 is a perspective exploded view of the present invention.
Figure 5:
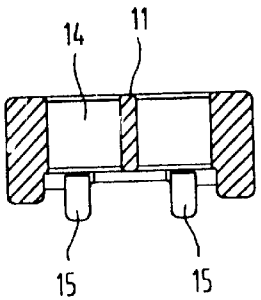
FIG. 5 is a sectional view taken along line V—V of FIG. 4.
Figure 3:
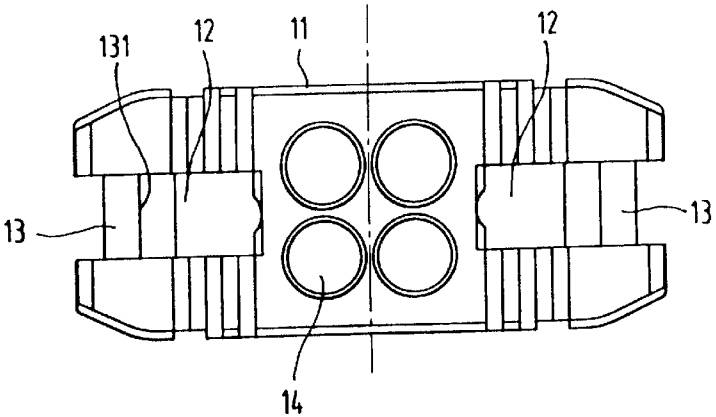
FIG. 3 is a front view of the panel body of the present invention.
Figure 4:
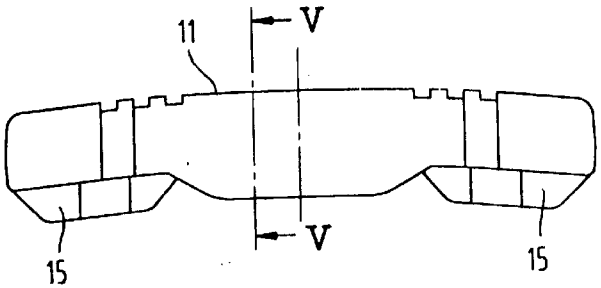
FIG. 4 is a side view of the panel body of the present invention.

Please refer to FIGS. 1, 2, 6 and 7. The fastening device 10 of the present invention includes a panel body 11 and an engaging block 20. Two ends of the panel body 11 are formed with cut sections 12 each having a locating shaft 13. The central portion of the panel body 11 is formed with multiple lace holes 14. The engaging block 20 is formed with a central recess 21 in which the locating shaft 13 is fitted.

Referring to FIGS. 2 to 5, the panel body 11 can be made of plastic material by integral injection. The bottom side of each cut section 12 is formed with two lateral lace guiding projections 15. The locating shaft 13 is formed with a concave 131.

Figure 6:
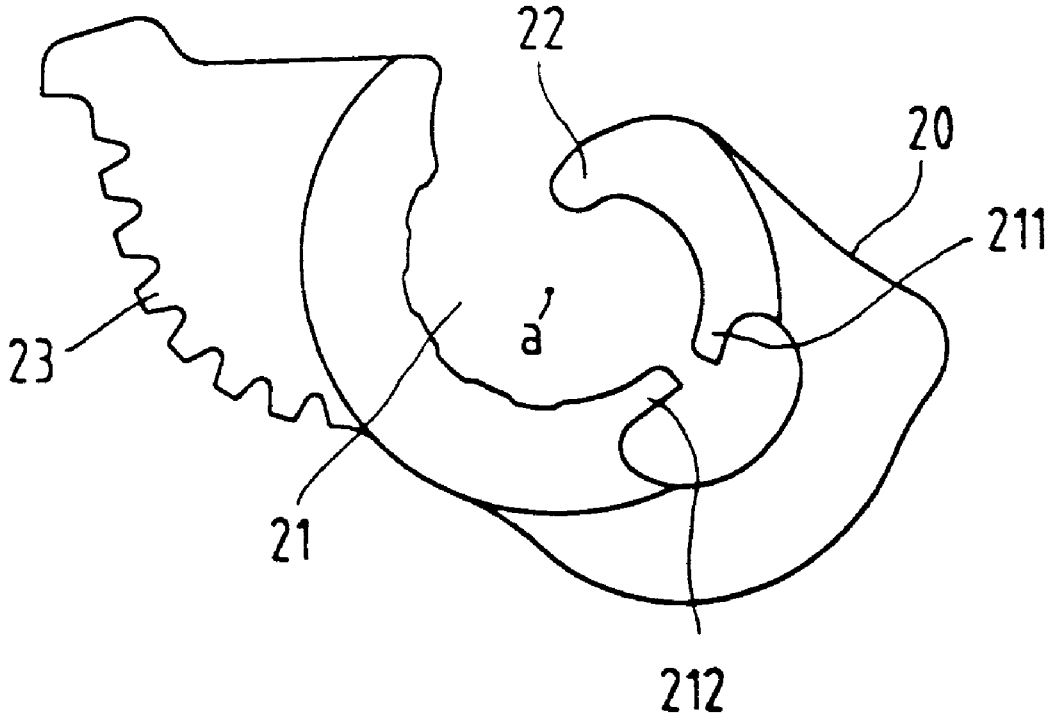
FIG. 6 is a side view of the engaging block of the present invention.

Referring to FIG. 6, the wall of the recess 21 of the engaging block 20 is formed with stopper projections 211, 212. A resilient tongue plate 22 is formed on outer edge of the recess 21. The engaging block 20 has a toothed section 23 eccentrically centered at the circular center a of the recess 21. When the engaging block 20 is clockwise rotated about the circular center a through a certain angle (about within 90 degrees ), the toothed section 23 provides a counterclockwise restoring force against the panel body 11.

Figure 7:
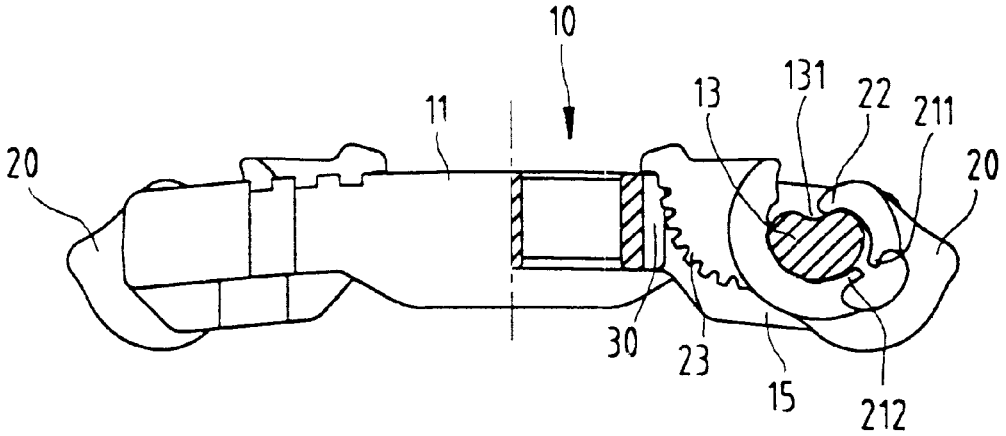
FIG. 7 is a side sectional assembled view of the present invention.
Figure 8:
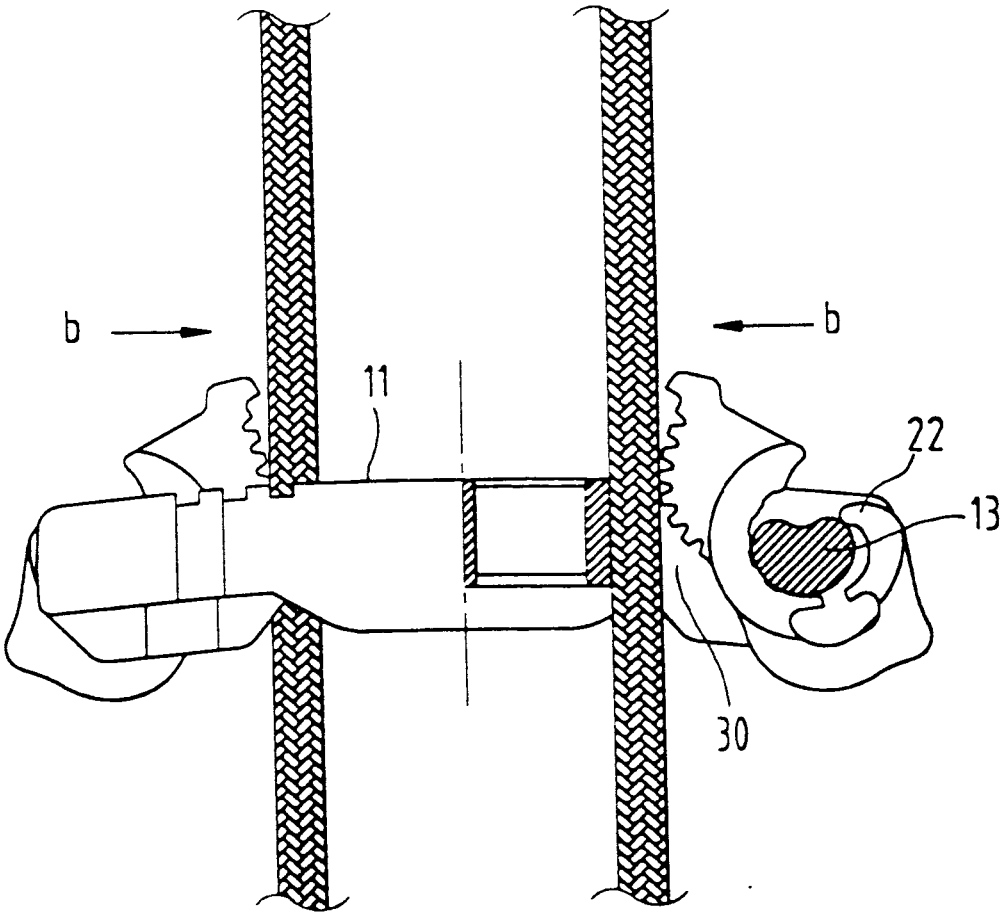
FIG. 8 shows that the lace is passed through the gap defined by the panel body and the engaging block and clamped thereby.

Referring to FIGS. 7 and 8, when assembled, the locating shaft 13 of the panel body 11 is fitted into the recess 21 of the engaging block 20 and then the engaging block 20 is rotated, making the toothed section 23 abut against the cut section 12 of the panel body 11 so as to define a lace access gap 30 therebetween. The tongue plate 22 of the engaging block 20 is located on the concave 131 of the locating shaft 13. The cross-section of the locating shaft 13 is none-circular so that when the engaging block 20 is forcedly outward turned by a lace passing through the gap 30 as shown in FIG. 8, the tongue plate 22 and the stopper projections 211, 212 provide resilient restoring pressure b due to the change of distance between the centers of the locating shaft 13 and the recess 21. The restoring pressure acts as a maintaining force for clamping the lace 40 passed through the gap 30. Accordingly, in cooperation with the passing movement of the lace, the engaging block 20 can clasp and fasten the lace tighter and tighter than the conventional butterfly knot.

When it is desired to loosen the lace without detachment, a user can pinch the two engaging blocks 20 at two ends of the fastening device 10 from outer sides thereof so as to enlarge the gap 30. At this time, the fastening device 10 can be slided from the fastening position to release the lace 40 from the clasping and securing force of the toothed section 23. Therefore, the fastening device can be freely slided along the lace 40 to a desired position without detaching from the lace. Then the lace can be pulled to be again tightened by the fastening device.

According to the above arrangement, the fastening device of the present invention has simple structure and easily fasten the lace. Also, the fastening device can be easily untightened to loosen the lace.

It should be noted that the above description and accompanying drawings are only used to illustrate one embodiment of the present invention, not intended to limit the scope thereof. Any modification of the embodiment should fall within the scope of the present invention.

What is claimed is:

1. A fastening device comprising:

a panel body formed with at least one lace hole, two ends of the panel body being formed with cut sections each having a locating shaft therein; and at least one engaging block formed with a central recess, a wall of the recess being formed with stopper projections, a resilient tongue plate being formed on outer edge of the recess, the engaging block having a toothed section eccentrically centered at the circular center of the recess, whereby when assembled, the locating shaft of the panel body is fitted into the recess of the engaging block which provides a resilient restoring pressure for clasping a lace.

2. A fastening device as claimed in claim 1, wherein the locating shaft is formed with a concave and the cross-section of the locating shaft is none-circular.

3. A fastening device as claimed in claim 1, wherein a bottom side of each cut section of the panel body is formed with two lateral lace guiding projections.

4. A fastening device as claimed in claim 1, wherein the resilient tongue plate of the engaging block abuts against the concave of the locating shaft of the panel body.

5. A fastening device as claimed in claim 1, wherein the number of the engaging blocks is equal to that of the cut sections of the panel body.

* * * * *